US008371568B2

(12) United States Patent
Herrmann et al.

(10) Patent No.: US 8,371,568 B2
(45) Date of Patent: Feb. 12, 2013

(54) ACTUATOR AND DUAL BIN SIZE BELT SYSTEM FOR MULTIPLE SIZE MEDIA TRANSPORT

(75) Inventors: Douglas K Herrmann, Webster, NY (US); John P Parson, Manhattan Beach, CA (US); Robert L Powell, Lakeville, MN (US)

(73) Assignee: Xerox Corporation, Norwalk, CT (US)

( * ) Notice: Subject to any disclaimer, the term of this patent is extended or adjusted under 35 U.S.C. 154(b) by 442 days.

(21) Appl. No.: 12/786,643

(22) Filed: May 25, 2010

(65) Prior Publication Data

US 2011/0291354 A1 Dec. 1, 2011

(51) Int. Cl.
*B65H 39/00* (2006.01)

(52) U.S. Cl. ..... 270/52.16; 270/52.14; 270/52.19; 270/58.29; 271/303; 271/287

(58) Field of Classification Search ..... 270/52.14, 270/52.16, 52.19, 58.29; 271/287, 288, 299, 271/303, 198

See application file for complete search history.

(56) References Cited

U.S. PATENT DOCUMENTS

| | | | | |
|---|---|---|---|---|
| 4,801,036 | A * | 1/1989 | Rathert | 270/58.29 |
| 5,288,063 | A * | 2/1994 | Lunt | 270/58.29 |
| 7,232,122 | B2 * | 6/2007 | Mayer et al. | 271/4.01 |
| 7,287,748 | B2 * | 10/2007 | Maeder et al. | 270/52.05 |
| 7,396,006 | B2 * | 7/2008 | Kapturowski et al. | 270/52.14 |
| 7,731,167 | B2 * | 6/2010 | Prim et al. | 270/52.22 |
| 7,857,297 | B2 * | 12/2010 | Ong | 270/52.16 |
| 7,891,648 | B2 * | 2/2011 | Abegglen | 270/52.16 |
| 8,262,074 | B2 * | 9/2012 | Langenegger | 270/52.22 |

* cited by examiner

*Primary Examiner* — Kaitlin Joerger
(74) *Attorney, Agent, or Firm* — Ronald E. Prass, Jr.; Prass LLP

(57) ABSTRACT

This is a media transport system that can accommodate various size media or sheets. The system has a series of even sized bins that can accommodate both small and large sheets. Above the bins is located a sheet diverter that when lowered diverts the small sheets into a small portion of the even sized bin. When the sheet diverter is raised, it permits the large sheets to be unblocked by it and fall into the largest portion of the even sized bin. When the large sheets are housed in the bin, they are supported on a short pusher which is located between two large pushers. Both the small and large sheets are in substantial collated alignment when housed in the bins.

16 Claims, 3 Drawing Sheets

ACTUATOR AND DUAL BIN SIZE BELT SYSTEM FOR MULTIPLE SIZE MEDIA TRANSPORT

This invention relates to a sheet transport system and, more specifically, to a sheet transport system for handling different size media.

BACKGROUND

While the present invention can be used for any suitable system to handle different size sheets, for clarity, it will be described in relation to use in a xerographic marking apparatus. Any suitable media can be used such as sheet materials, papers, etc. The term "cards" will be used and intended to be inclusive of any sheet media of different lengths.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets to be wrapped, etc.

As above noted, there are many marking systems that transport paper or other media after the paper is marked in marking step or steps. These marking systems could include electrostatic marking systems, non-electrostatic marking systems and printers or any other system where paper or other flexible media or receiving sheets are transported internally to an output device such as a finisher and compiler station or stations. These devices include those used for collecting or gathering printed sheets so they may be formed into sets such as books, pamphlets, forms, sales literature, instruction books and manuals and the like.

These electrostatic marking systems have finisher and compilers located at a site after the receiving sheets (paper) have been marked with a toner.

Multi-sheet collations when transported by a pusher belt system after marking either arrive to the belt unregistered are added unregistered to a pre-registered set or become unregistered during transport. Single and multi-sheet collations of different lengths are contained in the process direction by pushers but the length differences in the collations do not allow for side to side registration with fixed registration walls designed to accommodate the largest size. This causes misregistration in those stacks made up of any media with sizes smaller than the registration wall width dimensions.

SUMMARY

A common problem encountered with pusher type transports is misregistration and skewing of the media stack. This misregistration is caused by three main problems:

The set is placed onto the transport in an unregistered state because the bin size is too large for the media.

During the transport of the set, the set becomes unregistered as the smaller sheets move between pushers.

Pushers are spaced to accept the largest/longest media and the smaller media scatters between the pushers.

By designing a belt that uses different height pushers 2 "bins" can be formed to contain different size media. A smaller bin within a larger bin made up of taller pushers creates a system that allows for the transport of different size media while significantly reducing the scatter that is caused by transporting media that is too small for the pusher spacing.

To ensure that the media is controlled during placement onto the belt and is collated in the proper bin, an actuator is used to act as a diverter guide or paddle. This creates a stop to drive the smaller sheets into the smaller bin and keeps the sheets from overshooting the pusher. This actuated guide or paddle is then moved up and out of the way of the tallest pushers so the belt can translate without interfering with the pushers. In this way, the actuator does not contact the pushers and damage the pushers. Once the pusher has translated past the diverter paddle, the paddle can be actuated back down to the pusher to provide a stop for the next incoming sheet. This is all controlled by the system based on feedback of what size and number of sheets are arriving. Additionally, when the diverter is not needed for larger sheets, it is brought up and out of the way for the larger sheets being fed into the bin.

As is common in transports, this system involves a high acceleration in the process direction which causes shingling and scatter to the cards within the sets. By allowing for different sized bins and the means (actuated diverter) to put the media into each depending on size, the system is now able to transport even the smallest cards without jamming due to the reduction of the shingling/scattering effects.

This invention uses two different height pushers spaced to accommodate different size media. These pushers are spaced to provide two bin sizes that allow for bucketing different sized media to reduce shingling and scatter during transport.

To place the media in the appropriate bin, a diverter gate paddle is used to divert the media into the appropriate bin size. To accommodate different sizes of media as well as different height pushers, the diverter gate paddle is actuated to lower into position to divert smaller media into the smaller bin and then the diverter gate paddle is actuated to raise the paddle above the taller pushers during transport. The actuation is controlled by the system based on a signal using sensors and a controller to identify media size and sheet count.

DETAILED DISCUSSION OF DRAWINGS AND PREFERRED EMBODIMENTS

Figure 1:
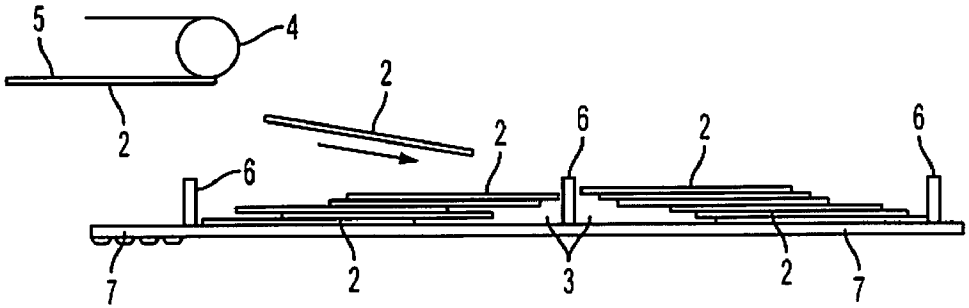
FIG. 1 PRIOR ART
FIG. 1 illustrates a typical prior art transport system where smaller and larger cards are collected in a scattered and non collated array.

In FIG. 1, a typical prior art system is illustrated where smaller 2 cards are collected in a skewed or decollated fashion in each bin 3. Only one size card is collected at a time before the pusher belt is indexed. The smaller cards 2 are fed to each bin 3 by a vacuum transport 4 which holds the cards 2 on a vacuum belt 5 until the cards are deposited into the bins 3. Short pushers 6 are used to separate bins 3 which are wide enough to hold the large cards 1 together with shorter cards 2. Once the cards are ready to be packaged and aligned for wrapping, they must be physically or otherwise stack aligned to be properly wrapped. The sheets 2 are scattered in each bin 3 in an unregistered manner. Typically, pusher belt systems are designed with bins 3 having bins sized for the largest media 1. While smaller than the bin 3 sized media or cards 2 can be used, the motion of the belt and the poor initial stacking result in unacceptable stack registration for wrapping the cards 2. The conveyor or timing belt 7 moves the bins 3 into position for loading.

Figure 2:
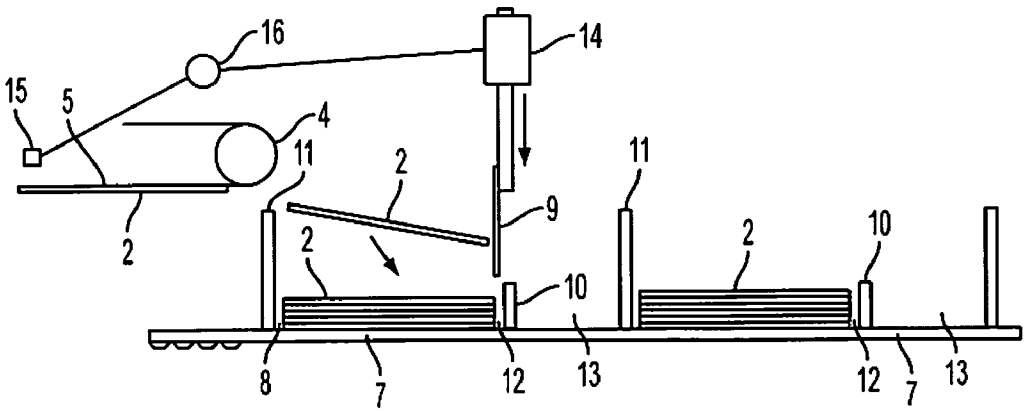
FIG. 2 illustrates an embodiment of this invention where smaller cards or sheets are accommodated in a collated fashion in each bin.

In FIG. 2, an embodiment of the present invention is shown with a system of dual bins 8 with an actuated diverter paddle 9 (of actuator 14) in a down position for smaller sheets 2. The present invention provides handling different sized media 1 and 2 by utilizing different height pushers 10 (smaller) and 11 (taller) creating a smaller sized bin 12 within a larger bin 13 made up of taller pushers 11. To ensure that cards 1 and 2 are controlled during placement onto the belt 5 and collated in the proper bin 12 or 13, an actuator 14 is used as a diverter guide. This creates a stop to drive the smaller cards 2 into the smaller bin 12 and keeps them from overshooting the pusher 10. This actuated guide 14 is moved up and out of the way of the tallest pusher 11 so that there is no interference. The actuator position is controlled by the card size and number of cards. A sensor or sensors 15 are used upstream together with a controller 16 to move the actuator 14 to an up or down position.

Figure 3:
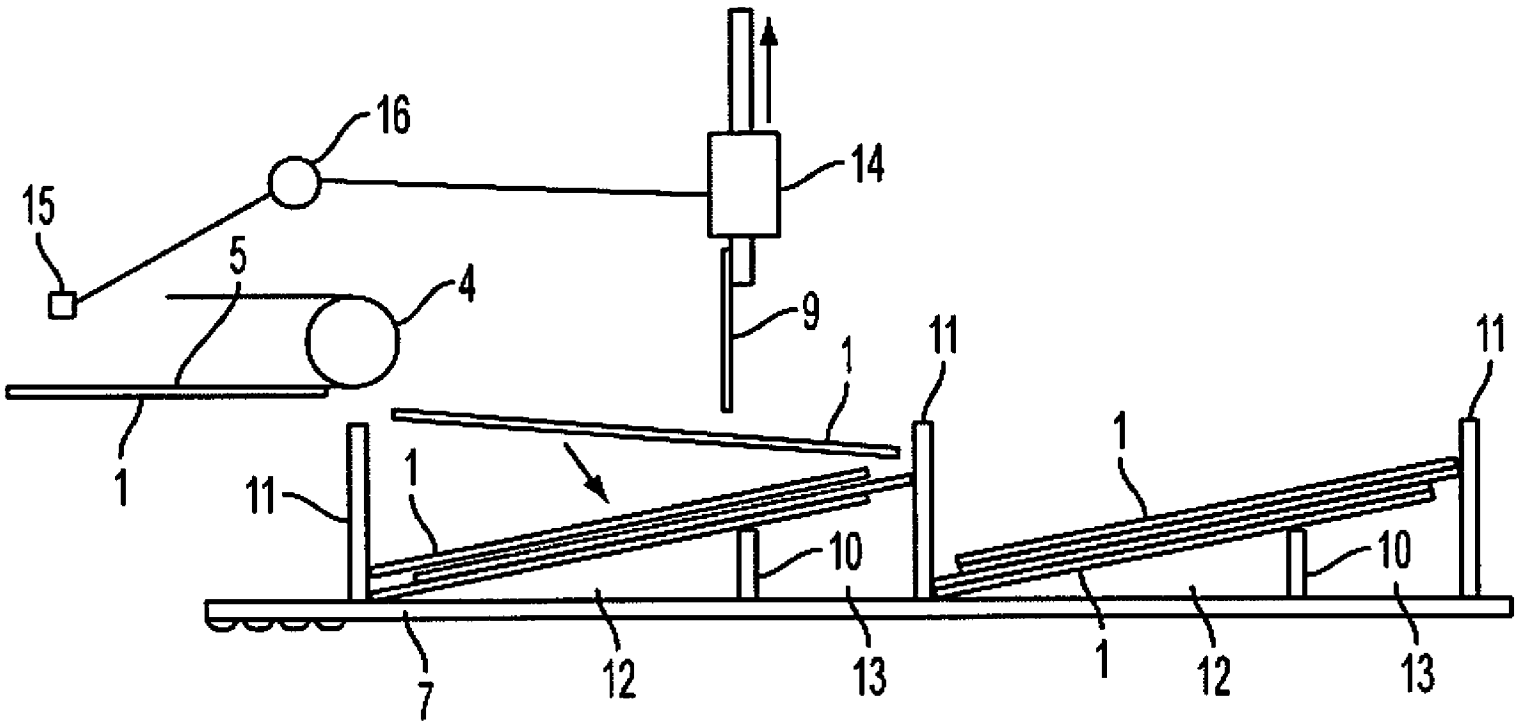
FIG. 3 illustrates an embodiment of this invention where larger cards or sheets are accommodated in a collated fashion in each collection bin.

In FIG. 3, an embodiment of the present invention is shown with a system of dual bins 8 with actuated paddle 9 in an up position for large sheet (or card) 1 feed and transport. This larger media 1 is stacked and aligned over the top of the smaller pusher 10. The diverter gate or paddle 9 is actuated and used in the up or raised position above the taller pushers 11 to permit the larger sheet or card 1 to fall into the larger bin 13 while resting in alignment on the smaller pusher 10. The sensors 15 and controller 16 identify the size of the media and instruct and put the actuator 14 in the proper up or raised position for larger media 1 handling. Once the conveyor belt 7 reaches the exit or collection point, the large sheets 1 are in collated position. The actuator 14 can be any suitable actuator such as a solenoid, air actuator or stepper motor.

Figure 4:
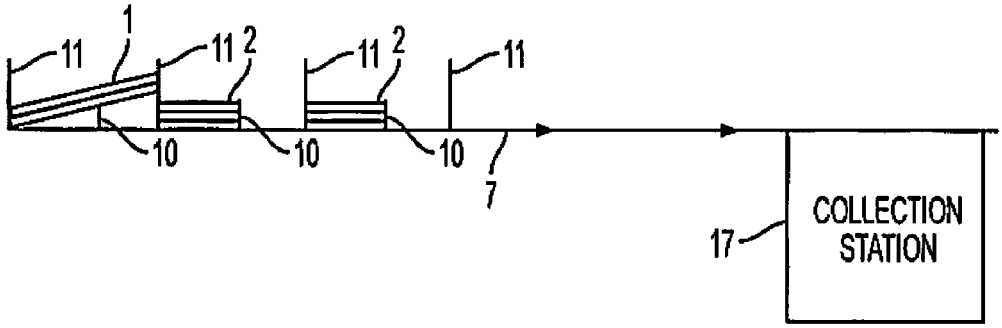
FIG. 4 illustrates the transport conveyer system where both larger cards and smaller cards have been deposited in the collection bins.

FIG. 4 illustrates how the series of bins can be loaded with cards 1 and 2 in each of the larger bins 13 and smaller bins 12. This system can be used at the collection stations 17 of a finisher or of a print engine. While only two size media are disclosed herewith, any number of different size media can be used with the proper sensors and controllers to indicate size.

To summarize, the present invention provides a media transport system for multiple size media transport comprising a bin transport belt having on its upper face a plurality of collection, smaller and larger, bins and pushers. The collection bins have on each terminal end tall pushers, and have at a point between the tall pushers a small pusher. An imaged media belt transport is located at a forward portion of the transport belt and is configured to deposit large and small marked media (or cards) in the collection bins. Positioned above the collection bins and in feeding relationship to the card transport is an actuator with a diverter paddle.

When the diverter paddle is in a down position, the small cards are deflected off the paddle and fall into the smaller bins. When the diverter paddle is in an up position, the large cards are unblocked by the diverter paddle and fall into the larger bins.

At least one sensor and controller are located upstream of the imaged media transport belt. The sensors are configured to sense the size of the media and with communication with the controller raise or lower the diverter paddle to correspond to the size of the media. The actuator could be selected from the group consisting of air actuators, solenoid actuators and stepper motor actuators.

The larger bins are configured to receive and house the large marked media. The large marked media when housed rests upon the top of the small pusher. The media when in the smaller and larger bins are in substantial collated alignment. The imaged media belt transport is a vacuum belt transport configured to hold a media thereon until deposited into one of the bins.

In another embodiment, this invention provides a media transport system for multiple size media transport comprising a bin transport belt having on its upper face a plurality of smaller and larger collection bins and pushers. The collection bins have on each terminal end tall pushers and have at a point between the tall pushers a small pusher. An imaged media belt transport is located at a forward portion of the transport belt and is configured to deposit large and small marked media (or cards) in the collection bins. Positioned above the collection bins and in feeding relationship to the card transport is an actuator with a diverter paddle. The bins are configured on the transport belt in a manner where every other pusher is a tall pusher and the remainder are short pushers. The bins, being of substantially uniform length throughout the bin transport belt and the bins are configured to hold either the small cards or the large cards in a substantially collated arrangement.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media transport system for multiple size media transport comprising:

a bin transport belt having on its upper face a plurality of collection, smaller and larger, bins and pushers, said collection bins having on each terminal ends tall pushers, and having at a point between said tall pushers a short pusher, an imaged media belt transport located at a forward portion of said transport belt configured to deposit large or small marked media (or cards) in said collection bins, and positioned above said collection bins and in feeding relationship to said card transport is an actuator with a diverter paddle.

2. The media transport system of claim 1 wherein when said diverter paddle is in a down position, small cards are deflected off said paddle and fall into said smaller bins.

3. The media transport system of claim 1 wherein when said diverter paddle is in an up position, large cards are unblocked by said diverter paddle and fall into said larger bins.

4. The media transport system of claim 1 wherein at least one sensor and controller are located upstream of said imaged media transport belt, said sensors configured to sense a size of said media and with communication with said controller raise or lower said diverter paddle to correspond to said size of said media and indexing of the transport belt.

5. The media transport system of claim 1 wherein said actuator is selected from the group consisting of air actuators, solenoid actuators and stepper motor actuators.

6. The media transport system of claim 1 wherein said larger bins are configured to receive and house said large marked media where said large marked media when housed rests upon a top of said small pusher.

7. The media transport system of claim 1 wherein said media when in said smaller or larger bins is in substantial collated alignment.

8. The media transport system of claim 1 wherein said imaged media belt transport is a vacuum belt transport configured to hold a media thereon until deposited into one of said bins.

9. A media transport system for multiple size media transport comprising:

a bin transport belt having on its upper face a plurality of smaller and larger collection bins and pushers, said collection bins having on each terminal ends tall pushers, and having at a point between said tall pushers a small pusher, an imaged media belt transport located at a forward portion of said transport belt configured to deposit large and small marked media (or cards) in said collection bins, and positioned above said collection bins and in feeding relationship to said card transport is an actuator with a diverter paddle, wherein said bins are configured on said transport belt where every other pusher is said tall pusher and the remainder said small pusher, and said bins being of substantially uniform length throughout said bin transport belt and said bins configured to hold either said small cards or said large cards in a substantially collated arrangement.

10. The media transport system of claim 9 wherein when said diverter paddle is in a down position, small cards are deflected off said paddle and fall into said smaller bins.

11. The media transport system of claim 9 wherein when said diverter paddle is in an up position, large cards are unbacked by said diverter paddle and fall into said larger bins.

12. The media transport system of claim 9 wherein at least one sensor and controller are located upstream of said imaged media transport belt, said sensors configured to sense a size of said media and with communication with said controller raise or lower said diverter paddle to correspond to said size of said media.

13. The media transport system of claim 9 wherein said actuator is selected from the group consisting of air actuators, solenoid actuators and stepper motor actuators.

14. The media transport system of claim 9 wherein said larger bins are configured to receive and house said large marked media where said large marked media when housed rests upon a top of said small pusher.

15. The media transport system of claim 9 wherein said media when in said smaller and larger bins is in substantial collated alignment.

16. The media transport system of claim 9 wherein said imaged media belt transport is a vacuum belt transport configured to hold a media thereon until deposited into one of said bins.

* * * * *